United States Patent [19]

Laine

[11] Patent Number: 4,818,343

[45] Date of Patent: Apr. 4, 1989

[54] DEVICE FOR CUTTING OFF AN EDGE STRIP AND FOR GUIDING THE EDGE STRIP IN CONNECTION WITH THE THREADING OF A PAPER OR BOARD WEB

[75] Inventor: Paavo Laine, Tampere, Finland

[73] Assignee: Oy Tampella AB, Tampere, Finland

[21] Appl. No.: 38,950

[22] Filed: Apr. 16, 1987

[30] Foreign Application Priority Data

Apr. 18, 1986 [FI] Finland ..... 861649

[51] Int. Cl.[4] ..... B26D 1/00

[52] U.S. Cl. ..... 162/286; 162/193; 162/194; 83/98; 83/99; 493/342; 493/363

[58] Field of Search ..... 162/286, 193, 194, 202; 83/98, 99, 24; 493/342, 363, 369

[56] References Cited

U.S. PATENT DOCUMENTS

| | | | |
|---|---|---|---|
| 1,637,240 | 7/1927 | Proctor | 162/193 |
| 3,355,349 | 12/1964 | Devlin | 162/286 |
| 4,648,942 | 3/1987 | Wanke et al. | 162/193 X |

*Primary Examiner*—Peter Chin
*Assistant Examiner*—Thi Dang
*Attorney, Agent, or Firm*—Banner, Birch, McKie & Beckett

[57] ABSTRACT

The invention relates to a device for cutting off and guiding an edge strip from one part of a paper or board machine to another in connection with the threading of a paper or board web. The device includes air jet nozzles for guiding the edge strip, and a threading plate which is provided with a cutting mechanism for cutting off the edge strip. In order to provide a device reliable in operation, the cutting mechanism including at least one blade member which is arranged to be displaced during the cutting of the edge strip in a plane substantially parallel to the plane of the threading plate from the front side of the threading plate towards the front edge thereof and to cut off the edge strip on the side facing away from the front edge of the threading plate and to guide the edge strip further on to the threading plate.

10 Claims, 2 Drawing Sheets

Figure 1:
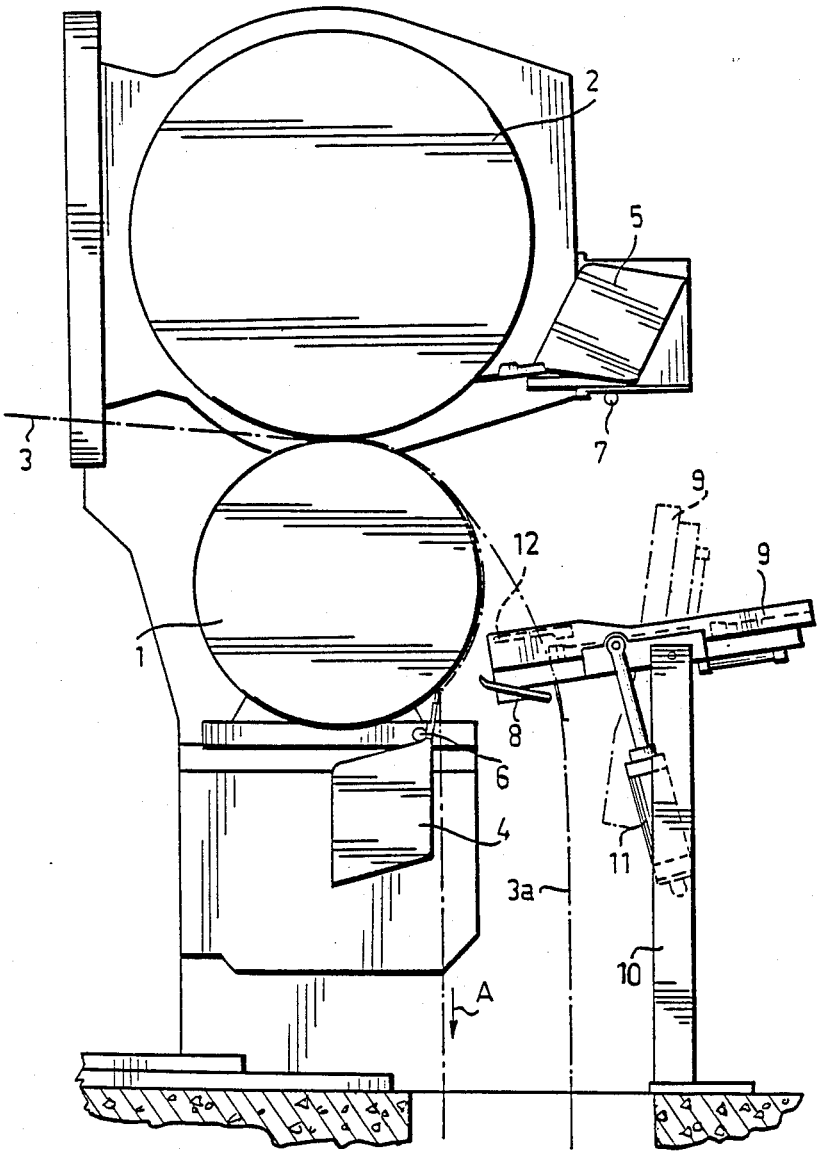

FIG. 3
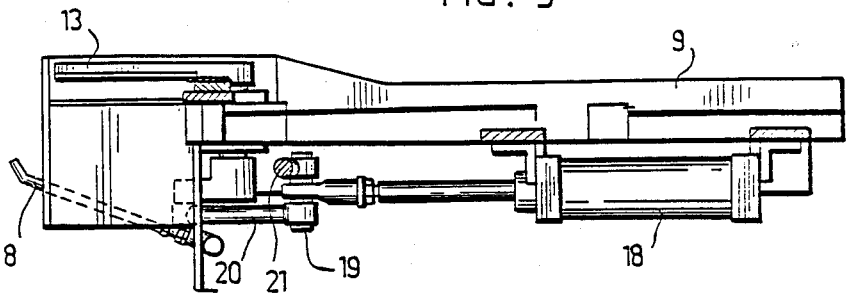
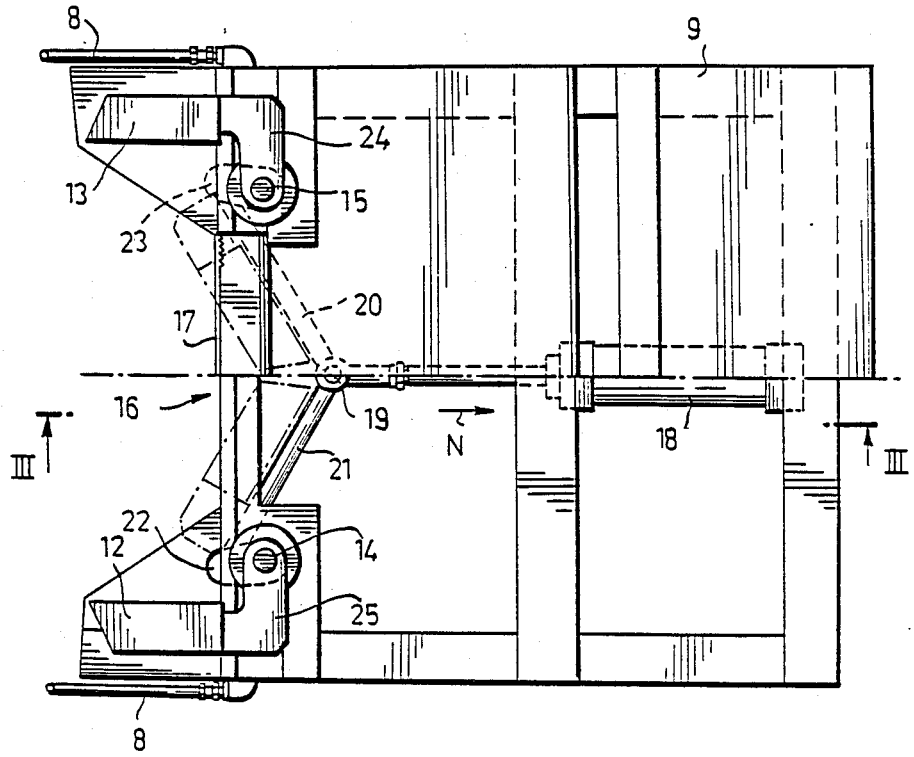
FIG. 2

DEVICE FOR CUTTING OFF AN EDGE STRIP AND FOR GUIDING THE EDGE STRIP IN CONNECTION WITH THE THREADING OF A PAPER OR BOARD WEB

A device for cutting off an edge strip and for guiding the edge strip in connection with the threading of a paper or board web.

The invention relates to a device for cutting off and guiding an edge strip from one part of a paper or board machine to another in connection with the threading of a paper or board web, comprising air jet nozzles for guiding the edge strip and a threading plate provided with cutting means for cutting off the edge strip.

Devices of this type are widely used in connection with the threading of a web in paper or paper board machines. The threading is thereby carried out by cutting a narrow edge strip, a so called leader or load strip, from the edge of a full-width web and by passing it onwards by means of air jets. Operational stages at which threading is utilized are, for instance, the transfer of a web from the last cylinder of the drying section on to a machine calender or from the machine calender to a reeler.

When transferring the end of a web, problems have arisen in that when the edge strip is first allowed to freely move towards a broke treating device positioned under the machine, and when it is then begun to be guided onwards by means of air jets, for instance, into the first gap of a calender or into a gap between a Pope-cylinder or a reeling drum, that part of the strip which is already going towards the broke treating device rises up, which slows down the threading. A further problem is that when the paper reaches the following nip, it is doubled on itself, which slows down the drive and hampers the passing of the strip between the rolls. Still another problem is that the process often includes manual stages, e.g. the strip has been cut off by hands, whereby the personal skill of the worker has been of particularly great importance. With increasing machine speeds, the operation becomes even more difficult to carry out successfully, as a result of which the amount of broke is increased.

Attempts have been made to solve these problems by means of different kinds of systems for displacing and cutting off the edge strip. One alternative is to use different kinds of mechanical displacing means for the transfer of the strip from a drying cylinder onto a calender, for instance. As compared with air jets mentioned above this kind of mechanical structures, however, are rather expensive on account of the complicated realization. Nor is the operational reliability of mechanical solutions the best possible.

The solutions disclosed in Finnish Patent Specification No. 52,478 and Finnish Patent Specification No. 62,695 may be mentioned as examples of structures utilizing air jets. A disadvantage common to those known solutions is that they are relatively complicated and cannot be used at all places. The solution of Finnish Patent Specification No. 52,478 also has the disadvantage that the cutter brings about a security risk. A disadvantage of Finnish Patent Specification No. 62,695, in turn, is that it is unsuitable for heavy web materials, such as board, because the mechanical strength of these materials is so high that the cutting cannot be carried out by means of air jets in a manner described in Finnish Patent Specification No. 62,695.

The device disclosed in U.S. Patent Specification No. 3,355,349 may be mentioned as an example of devices for cutting off the edge strip. A disadvantage of such devices is that they bring about security risks and, above all, that they are not sufficiently reliable in operation.

The object of the invention is to provide a device for cutting off and guiding an edge strip in connection with threading, which device avoids the disadvantages of prior devices. This is achieved by means of a device according to the invention which is characterized in that the cutting means comprise at least one blade member displaceable during the cutting of the edge strip in a plane substantially parallel to the plane of the threading plate from the front side of the threading plate towards a front edge thereof for cutting off the edge strip on the side facing away from the front edge of the threading plate and for guiding the edge strip further on to a threading plate.

The device according to the invention is advantageous mainly in that it can also be used with web materials having a high grammage. Manual operations are omitted and the device is more secure and more reliable in operation than prior devices. The improved reliability of operation has a result that the amount of broke is decreased, the effective driving time becomes longer, and the profitability of the process as a whole is improved as compared with the prior art.

The invention will be described in the following by means of a preferred embodiment shown in the attached drawing, wherein FIG. 1 is a general side view of a device according to the invention when arranged in connection with the calender of a paper machine, FIG. 2 is a general vertical view of a threading plate of the device of FIG. 1, and FIG. 3 is a sectional view in the direction of the arrows III—III shown in FIG. 2.

FIG. 1 illustrates generally two lowest rolls 1, 2 of the calender of a paper machine. A paper web or a board web is indicated by the reference numeral 3 in FIG. 1. The reference numerals 4, 5 denote doctor blades and the reference numerals 6, 7 and 8 denote air jet nozzles in FIG. 1. The air jet nozzles 6, 7 are positioned in connection with the doctor blades, and the nozzles 8, in turn, in the vicinity of the front edge of a pivotably arranged threading plate 9. The threading plate 9 is supported on a supporting structure 10 and arranged to be pivoted from a free position to an operation position by means of an actuating device, such as a pressure air cylinder 11. This free position is indicated by broken lines in FIG. 1 and the operation position correspondingly by a continuous line.

At the initial stage the web 3 and an edge strip separated from the edge thereof are led into a broke treating device, the direction towards the device being indicated by the arrow A in FIG. 1. Since the distance to the water surface of the broke treating device is several metres, the weight of the loosely hanging strip is fairly great. Therefore, if the strip is tried to be passed on the threading plate 9 positioned in the operation position by means of the air jets, the strip is bent and folded double in the area of the nozzle, i.e. that portion of the strip which was already passing towards the broke treating device is drawn backwards. This is the reason for the above-mentioned disadvantages of the prior art. The disadvantages are further aggravated when the edge strip cutting device positioned on the front edge of the threading plate does not operate reliably.

According to the invention this cutting device comprises at least one blade member 12, 13. When an edge strip 3a is to be cut off, the blade member is arranged to be displaced in a plane substantially parallel with the threading plate 9 from the front side of the threading plate towards its front edge and to cut off the edge strip 3a on the side facing away from the front edge of the threading plate and further to guide the strip onto the threading plate 9. The expression "from the front side of the threading plate 9" means that the blade member 12, 13 is displaced in the desired displacing direction of the edge strip towards the front edge of the threading plate so that it simultaneously draws the cut edge strip therealong onto the threading plate.

FIGS. 2 and 3 illustrate one preferred embodiment of the invention, whereby the figures illustrate threading plate 9 as seen from different directions. In the embodiment of FIGS. 2 and 3, the cutting device comprises two blade members 12, 13 which are mounted pivotably on shafts 14, 15 arranged in the front corners of the threading plate substantially perpendicular to the plane of the threading plate. The blade members 12, 13 are arranged to form a receiving gap 16 for the edge strip 3a together with the front edge 17 of the threading plate 9. The blade members 12, 13 are arranged to be simultaneously pivotable towards the symmetry axis of the threading plate and to meet the edge strip close to the bottom of the receiving gap 16 formed by the front edge 17 of the threading plate acting as a counter blade.

The movement of the blade member(s) at the cutting stage is shown in FIG. 2, wherein the initial position is shown by a continuous line and the final position with a broken line. The movements of the blade members 12, 13 thereby take place in a plane above the plane of the threading plate, as appears from FIG. 3. When the edge strip is being cut, the blade members are displaced from the initial position to the final position at least partly above the threading plate, so that the end of the strip is guided reliably on to the threading plate.

In order to provide an advantageous operation, the blade members 12, 13 can be arranged to move by means of the same actuating means 19, 20, 21, 22, 23, 24 25. A pressure air cylinder 18, for instance, can be used for supplying power to the actuating means.

In principle, the device according to the invention operates in the following way. The edge strip 3a first comes along with the web 3 from the calender and further goes on towards the broke treating device, as shown in FIG. 1 by the arrow A. When the edge strip 3a is to be passed on towards the terminal end of the machine, the threading plate 9 is pivoted by means of the actuating means 11 to the operation position shown by the continuous line in FIG. 1 so that the front edge of the threading plate turns towards the calender. Thereafter the edge strip 3a is displaced close to the bottom of the gap 16 by means of the nozzle 6 provided in the doctor blade 4, the nozzles 8 provided in the threading plate 9 and additional nozzles and auxiliary means, if necessary. When the edge strip 3a is to be cut off so that the end of the strip can be led on to the threading plate 9 and further to additional threading plates and on to a reeler, in one embodiment, the actuating means 18 displaces a pin 19 in the direction of the arrow N, and this linear movement is transferred to transmission levers 22, 23 through rods 20, 21. The transmission levers 22, 23 transmit the movements in a circular form around shafts 15, 16 to blade retainers 24, 25 and further to the cutting blade members 12, 13. This effects such a movement of the blade members 12, 13 that they meet the edge strip 3a close to the bottom of the gap 16, cut off the strip on that side of the strip which faces away from the bottom of the gap 16, and guide the strip end remaining above the blade members on the threading plate, possibly by means of air jets. The edge strip portion remaining below the blade members naturally falls down to the broke treating device. The edge strip on the threading plate 9 is passed on along the surface of the threading plate 9 by means of the movement of the web and the air jets (in the figures from the left to the right) on to the following machine parts, such as the following threading plates, a machine calender or a reeling drum, etc. If necessary, this can be effected by means of additional nozzles 7, for instance. After the threading has been completed, the blade members 12, 13 can be returned to the initial position shown by the continuous line in FIG. 2.

The above embodiment is by no means intended to restrict the invention, but the invention can be modified within the scope of the attached claims in various ways. Accordingly, it is obvious that the device according to the invention or the parts thereof do not need to be exactly similar to those shown in the figures, but other kind of solutions can be used as well. The gap of the threading plate can, for instance, be provided with any suitable guides by means of which the edge strip can be led to a desired position in the sideward direction of the gap. The actuating means can be any suitable power source, and each blade member can be provided with actuating means of its own, if required.

What is claimed is:

1. A device for cutting off and guiding an edge strip from one part of a paper or board machine to another in connection with the threading of a paper or board web, the device comprising:

an edge strip receiving portion, air jet nozzles mounted adjacent the edge strip receiving portion for guiding the edge strip, a web path, and a threading plate having a front end facing the web path and being provided with cutting means for cutting off the edge strip and guiding the edge strip onto the threading plate, said cutting means comprising at least one blade member having a cutting edge and being pivotally mounted on the front end of the threading plate adjacent the edge strip receiving portion, said at least one blade member, relative to the threading plate, being only pivotally displaceable, and displacement means for pivotally displacing the blade member and cutting edge in a plane substantially parallel to the plane of the threading plate so that the blade member cuts off the edge strip on the side facing away from the front end of the threading plate and guides the edge strip onto the threading plate.

2. A device for cutting off and guiding an edge strip from one part of a paper or board machine to another in connection with the threading of a paper or board web, the device comprising:

an edge strip receiving portion, air jet nozzles mounted adjacent the edge strip receiving portion for guiding the edge strip, a web path, and a threading plate having a front end with corners facing the web path and being provided with cutting means for cutting off the edge strip and guiding the edge strip onto the threading plate, said cutting means comprising two blade members pivotally mounted on shafts arranged substantially in the front corners of the threading plate adjacent the edge strip receiving portion, the blade members and the front end of the threading plate forming a receiving gap for the edge strip, and the blade members being simultaneously pivotable toward a symmetry axis of the threading plate to meet the edge strip close to the bottom of the receiving gap, and displacement means for pivotally displacing the blade members in a plane substantially parallel to the plane of the threading plate so that the blade members cut off the edge strip on the side facing away from the front end of the threading plate and guide the edge strip onto the threading plate.

3. A device according to claim 1 wherein each blade member is positioned in a plane substantially above the plane of the threading plate.

4. A device according to claim 3 wherein the displacement means comprises a single actuating device coupled to said at least one blade member for displacement thereof.

5. A device according to claim 4 wherein the actuating device comprises a pressurized air cylinder.

6. A device according to claim 2 wherein each blade member is positioned in a plane substantially above the plane of the threading plate.

7. A device according to claim 6 wherein the displacement means comprises actuating means for displacing each blade member, said blade members being coupled to the actuating means in parallel.

8. A device according to claim 7 wherein the actuating means comprises a pressurized air cylinder.

9. A device according to claim 2 wherein the displacement means comprises actuating means for displacing each blade member, said blade members being coupled to the actuating means in parallel.

10. A device according to claim 9 wherein the actuating means comprises a pressurized air cylinder.

* * * * *